US005806838A

United States Patent [19]

Kalve et al.

[11] Patent Number: 5,806,838

[45] Date of Patent: Sep. 15, 1998

[54] HYDRAULIC SYSTEM FOR DRIVING A WINCH DURING QUARTERING AND LIFTING MODES

[76] Inventors: Atle Kalve, Nesjaveien 13, N-5087 Hordvik; Normann S. Jacobsen, Våkleivbakken 107, N-5062 Bønes, both of Norway

[21] Appl. No.: 862,574

[22] Filed: May 23, 1997

Related U.S. Application Data

[63] Continuation of Ser. No. 557,051, filed as PCT/NO93/00087, Jul. 1, 1993 published as WO94/27864, Dec. 8, 1994.

[51] Int. Cl.[6] ..... B66D 1/08

[52] U.S. Cl. ..... 254/361; 254/900

[58] Field of Search ..... 254/900, 361, 254/379

[56] References Cited

U.S. PATENT DOCUMENTS

| | | | |
|---|---|---|---|
| 3,780,990 | 12/1973 | Edlund et al. | 254/361 |
| 3,871,714 | 3/1975 | Behrend | 254/379 X |
| 4,547,857 | 10/1985 | Alexander | 254/900 X |

FOREIGN PATENT DOCUMENTS

| | | | |
|---|---|---|---|
| 592664 | 2/1978 | U.S.S.R. | 254/900 |
| 2096563 | 10/1982 | United Kingdom | 254/900 |

*Primary Examiner*—Donald P. Walsh
*Assistant Examiner*—Emmanuel M. Marcelo
*Attorney, Agent, or Firm*—McAulay Fisher Nissen, Goldberg & Kiel, LLP

[57] ABSTRACT

The hydraulic system is used to drive a hydraulic motor for operation in a quartering direction for lowering of cargo as well as for operating the drive motor in a lifting direction. The hydraulic system employs an oil-gas accumulator which accumulates pressure oil during a quartering mode of operation of the drive motor. During a subsequent lifting mode of operation of the drive motor, stored pressure oil is used for the operation of the drive motor.

9 Claims, 3 Drawing Sheets

HYDRAULIC SYSTEM FOR DRIVING A WINCH DURING QUARTERING AND LIFTING MODES

This is a continuation continuation, of application Ser. No. 08/557,051, filed as PCT/NO93/00087 Jul. 1, 1993 published as WO94/27864 Dec. 8, 1994.

Present invention relates to a hydraulic system in connection with the quartering of cargo, such as life boats or rafts, via a winch having a control valve and associated hydraulic drive motor, by means of the force of gravity and subsequent lifting of cargo or empty books by means of hydraulic motive power. The one operative side of the hydraulic drive motor is connected to the control valve via a first conduit connection having a first back pressure valve, which prevents the flow of pressure oil from the control valve to the drive motor, but allows the flow of pressure oil from the drive motor to the control valve, the drive motor, during operation of the winch in the quartering direction having a cargo (the raft) hanging in the hook of a hoisting wire and with the control valve in the quartering position, being connected to an oil-gas accumulator for the storage of pressure oil.

In connection with life saving operations at sea where a number of life rafts or life boats are to be launched in succession one after the other from one and the same launching station, there is a need for a hydraulic system, which is reliable under a variety of operating conditions and particularly during occasionally occurring, difficult operation circumstances, such as acute crisis situations on board ship, oil platforms etc. A system of the kind indicated by way of introduction is known from DE 38 34 981. In the known solution one is dependent upon the use of hydraulic pumps.

With the present invention the aim is a solution which can be employed without the use of hydraulic pumps.

Present invention thus relates to a hydraulic system which is specifically designed for use in such crisis situations, where an electrical or other power source is cut out or can cut out during operation, without this having an influence on the operation of the hydraulic system.

However the hydraulic system is not limited to such an application, but for operatively advantageous reasons is also applicable for conventional purposes in normal operative situations, for example in usual, sequentially following unloading operations at work locations at sea or on land.

With the present invention the aim is a hydraulic system, which makes it possible to quarter a number of units of cargo in succession, with intermediate lifting of empty hooks, without the use of electrical or similar sources of power. Alternatively the aim is to be able to carry out a quartering operation in combination with an individual launching operation, for example for rapid and unhindered launching of a so-called "MOB-boat" (man over-board boat).

The hydraulic system according to the invention is characterised in that, one operative side of the drive motor is connected in addition to the control valve via a second conduit connection with a second back pressure valve, which permits the free flow of pressure oil from the control valve to the drive motor and prevents the flow of pressure oil from the drive motor to the control valve, the drive motor with the control valve in the lifting position, being connected to the oil-gas accumulator for the supply of pressure oil for the operation of the drive motor in the lifting position.

With the proposed solution it is generally possible to conduct the work of the winch exclusively by means of the power which is stored in the oil-gas accumulator and which is based on the quartering of cargo. The quartering work itself employs the drive motor as a pump so as to pump oil for storage in the accumulator. Lifting of empty hooks on the other hand is effected by feeding stored pressure oil from the accumulator to the drive motor. However extra work operations can be normally performed with the stored pressure oil in addition to the lifting of empty hooks, for example lifting and quartering and thereafter also the lifting of empty hooks, in instances where this is necessarily desirable. With the power stored in the accumulator, which is achieved on quartering a heavy cargo it will also be possible to raise a lighter cargo in addition to the empty hook.

Further features of the present invention will be evident from the following description having regard to the accompanying drawings in which.

Figure 1:
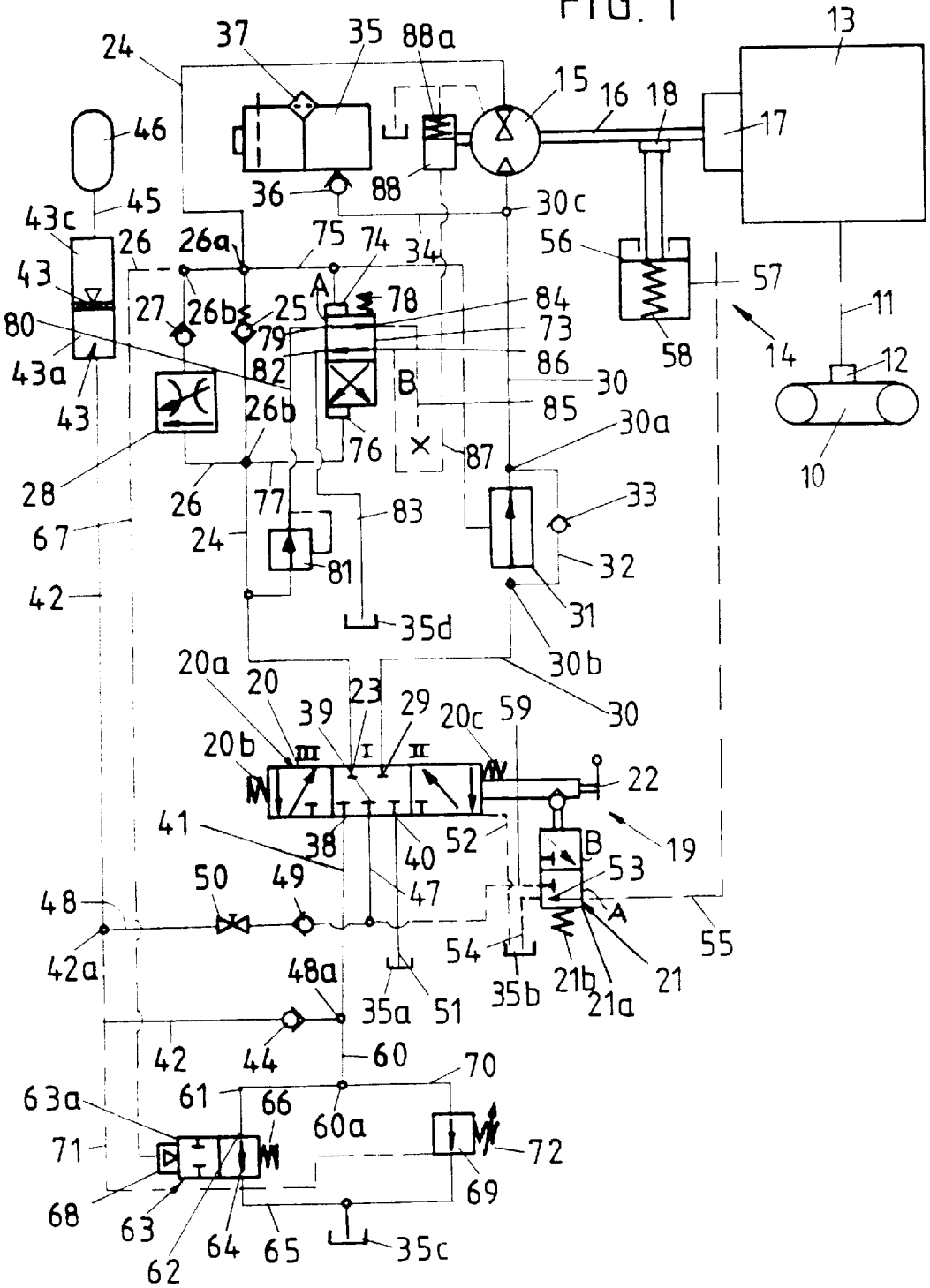
FIG. 1 shows schematically a hydraulic system according to the invention.

In FIG. 1 there is shown a raft (10) which is suspended from a hoisting wire 11 via a releasable hook holder mechanism 12 in the raft 10. The wire 11 is wound up on a drum 13 of a hoisting and quartering winch 14. The winch 14 is driven by a hydraulic drive motor 15 via a drive shaft 16 having an associated gear 17. Between the drive motor 15 and the gear 17 there is inserted a springloaded brake 18 controlled by pressure medium.

The drive motor 15 forms a part of a hydraulic system which is controlled by means of a control valve 19. The control valve 19 comprises a three-way main slide valve 20 for controlling the drive motor 15 and an extra two-way slide valve 21 for controlling the brake 18.

Main slide valve 20 of the control valve 19 is controlled by a control handle 22, which by axial displacement can adjust slide 20*a* of the main slide valve 20 into a starting position (neutral position), that is to say into a central position I, as shown in FIG. 1, and into two opposite outer positions II (displaced towards the left in FIG. 1) and III (displaced towards the right in FIG. 1) against the force from two equivalent opposite springs 20*b* and 20*c*. In the outer position II the control valve 19 is adjusted into a lifting position for the operation of the motor 15 with associated drum 13 in a lifting direction, while in the outer position III the control valve 19 is adjusted into a quartering position for operation of the motor 15 with associated drum 13 in a quartering direction.

The control handle 22 is also employed for controlling the slide valve 21 for the brake 18, the control handle 22 in such a case being moved in a direction across the direction of movement of the slide 20*a*, that is to say in the direction of movement of slide valve 21*a* of the slide valve 21. In FIG. 1 the slide 21*a* is shown in normal position A, in which the brake 18 is active. By displacing the slide 21*a* vertically downwards in FIG. 1 from normal position A to the opposite outer position B, against the force from a spring 21*b*, the brake is readjusted to a released, inactive position which permits turning of the shaft 16 with the drum 13 in a lifting direction or quartering direction determined by the setting of the slide 20*a* in the main slide valve 20.

On its one side the drive motor 15 is connected to a first port opening 23 in the main slide valve 20 via a first conduit connection 24 having an associated spring-loaded back pressure valve 25 inserting in same. The back pressure valve 25 permits pressure medium to be led from the port opening 23 to the motor 15, but prevents pressure medium from being led from the motor 15 to the port opening 23. In a circulation conduit 26, which is arranged outside the back pressure valve 25 and which extends between the points 26*a* 26*b* in the conduit 24, there is inserted a back pressure valve 27 and a pressure-compensated quantity valve (throttle valve) 28. The pressure medium from the motor 15 towards the port opening 23 can pass the back pressure valve 27 and is thereby regulated in amount via the subsequent quantity valve 28.

On the other side the drive motor 15 is connected to a second port opening 29 in the main slide valve 20 via a second conduit connection 30 having a sequential valve 31 inserted in same. In a circulation conduit 32, which is arranged outside the sequential valve 31 and which extends between the points 30*a*,30*b* in the conduit 30, there is inserted a back pressure valve 33. The back pressure valve 33 prevents pressure medium from the port opening 29 from being transferred to the motor 15 outside the sequential valve 31, but allows pressure medium from the motor 15 to the port opening 29 to be led outside the sequential valve 31.

In the conduit 30 at a point 30*c* there is connected a feed conduit 34 from a pressure medium tank 35 via a back pressure valve 36 which prevents pressure medium from being led back from the conduit 30 to the tank 35. The tank 35 is supplied pressure medium via a filter 37 from the return oil tanks 35*a* and 35*c*. The main slide valve 20 is as mentioned provided on its one side with two port openings 23 and 29, and is provided on its opposite side with three port openings 38, 39, 40.

The port opening 38 is connected via a conduit 41 and a branch conduit 42 to an oil chamber 43*a* in an accumulator 43 via a back pressure valve 44 in the conduit 42. The back pressure valve 44 allows pressure oil to be led from the port opening 38 to the accumulator 43, but prevents pressure oil being forced from the accumulator 43 back to the port opening 38. The accumulator 43 is provided on the opposite side of a membrane 43*b* with a gas chamber 43*c* which is connected via a conduit 45 to a gas flask 46.

The port opening 39 is connected via a conduit 47 and a branch conduit 48 to the conduit 42 at a point 42*a* between the check valve 44 and the accumulator 43. In the conduit 48 there is inserted a back pressure valve 49 and a shut off valve 50. The back pressure valve 49 allows pressure oil to be led from the accumulator 43 to the port 39 but prevents oil being led from the port opening 39 to the accumulator 43.

The port opening 40 is connected by means of a return tank 51 to a return oil tank 35*a*.

A branch tank 52 extends to the return oil conduit 35*b* from the main slide valve 20 of the control valve 19.

From the slide valve 21 there extends from a first port opening 53*a* return conduit 54 to the return oil tank 35*b*. In the illustrated starting position A for the slide 21*a* the branch conduit 54 communicates with a conduit 55 connected to the one side of a brake piston 56 in a brake housing 57, while a compression spring 58 acts against the opposite side of the brake piston.

From the slide valve 21 there extends from a second port opening 53*b* a branch conduit 59 to a junction 48*b* between the conduits 47, 48. In the said outer position B (by displacing the slide 21*a* in a direction downwardly in FIG. 1) the conduit 59 is brought into connection with the conduit 55, so that pressure oil is supplied from the accumulator 43 to the chamber on the upper side of the piston 56 in the brake housing 58 and the spring 58 is pressed together, so that the braking force of the brake 18 ceases and the motor 15 (by displacing the slide 20*a* from the central position(I)) can be turned in the quartering direction (position III) or in the lifting direction (position II). In both position II of the slide 20*a* (during lifting of the raft 10) and in position III (during quartering of the raft 10), the conduit 59 receives pressure oil from the accumulator 43 via the conduits 42, 48 and 47. Quartering of rafts with cargo.

1) During quartering of the raft (with the slide 20*a* in the outer position III) pressure oil is conveyed from the motor 15 via the conduit 24 and the port opening 23 to the port opening 38 and via the conduits 41, 42 to the accumulator 43.

2) After having quartered the bulk of the quartering height of the raft 10 the accumulator will normally be fully charged.

3) During continued quartering of the raft the accumulator will not normally be charged further. In practice for example half of the power of pressure oil which is produced in a quartering operation can be stored in the accumulator before the storage of additional power is interrupted.

The conduit 41 from the port opening 38 is connected via the junction 48*a* to a conduit 60 via a junction 60*a* and a branch conduit 61 having a port opening 62 in a sequential valve 63. On the opposite side the sequential valve 63 is connected via a port opening 64 and a conduit 65 to a return oil tank 35*c*. In the starting position of the sequential valve 63, as shown in FIG. 1 and which is secured with a compression spring 66, the conduits 41, 60 are drained to the return oil tank 35*c*. The sequential valve 63 is controlled via the pilot pressure in a branch conduit 67 from a junction 26*b* in the conduit 26 via a control chamber 68. On displacing slide 63*a* of the sequential valve 63 towards the right in FIG. 1, against the force of the spring 66 the draining via the sequential valve to the return oil tank 35 is blocked. A discharge valve 69 which is inserted in a branch conduit 70 from the junction 60*a* to the return oil tank 35*c* is controlled by a pilot pressure in a branch conduit 71 which branches off from the conduit 42 to the one side of the discharge valve 69. The discharge valve 69 is maintained in an uncoupled condition by means of a regulatable pressure force from a compression spring 72, but on high pilot pressures occurring in the conduit 71 from the conduit 42 the valve 69 is opened, so that pressure oil from the port opening 38 can be led directly to the return oil tank 35. The back pressure valve 44 closes for the flow from the accumulator via conduit 42 to conduit 41.

Thereafter the quartering continues until the raft reaches its lower position, without the accumulator 43 being additionally charged.

A hydraulically operated directional valve 73 is placed outside the spring-loaded back pressure valve 25 in the conduit 24 in parallel to the back pressure valve 25. The directional valve 73 has a first control chamber 74, which is connected via a branch conduit 75 to the junction 26*a* in the conduit 24, and a second, opposite chamber 76, which is connected via a branch conduit 77 to the junction 26*b* in the conduit 24. The directional valve 73 is maintained in starting position A by means of a compression spring 78. A first port 79 in the valve 73 is connected to the conduit 24 via a conduit connection 80 through a pressure reduction valve 81, while a second port 82 in the valve 73 is connected via a conduit 83 to the return oil tank 35*a*.

In the starting position A, as illustrated in FIG. 1, the port 79 is connected to a port opening 84 to a blind conduit 85, while the port 82 is connected to a port opening 86 to a conduit 87 to a position cylinder 88, which regulates the displacement of the motor 15 in the starting position A the motor 15 is adjusted for maximum displacement estimated for a maximum quantity of oil during quartering and lifting of the raft 10 via the drum 13, that is to say while the raft exerts a specific pull on the hoisting wire 11.

Lifting with empty hooks.

On lifting with empty hooks, that is to say after a raft has come down on the sea and the hook is to be lifted to the starting position for coupling to a subsequent raft, one desires to employ the same speed of rotation in the motor, but with minimal displacement, the displacement then being reduced to approximately a third of the maximum displacement (for example 29%, by employing a relative max./min. displacement of for example 3.4/1). Consequently a significantly lower quantity of oil is used on lifting empty hooks than on lifting hooks having associated rafts (and possible cargo).

Readjustment of the displacement from max.(3.4) to min. (1) takes place on the occurrence of a pressure drop over the throttle valve 28 and the slide valve 73 is readjusted to position B, whereby the blind conduit 85 is set connected to the return oil tank 35 via the conduit 83, while the conduit 80 through the pressure reduction valve 81 is set connected to the position cylinder 88 via the conduit 87 and readjusts the position cylinder 88 against the force of a spring 88*a*.

Quartering with empty hooks.

On quartering of empty hooks reduced speed relative to the speed on lifting with empty hooks is employed. In the starting position the accumulator 43 is charged and the main slide 20*a* of the control valve 19 is moved towards the right in FIG. 1 so that the left symbol (position III) is installed. The motor 15 is now driven as a normal winch, since the motor gets its supply of pressure oil from the accumulator 43. As the hook of the wire 11 is without a load, there is not any cargo which can drive the motor as a pump. Accordingly no significant drive pressure is required in the quartering direction between the motor 15 and the quantity regulating valve 28, assuming that the amount of outgoing oil from the accumulator is less than the adjusted value for the amount through the quantity regulating valve 28. At low oil pressures in the conduit 30 the sequential valve 31 in the conduit 30 and the sequential valve 63 in the conduit connection 60–65 will be open and pressure oil can be led from main valve 20 of the control valve 19 via the port openings 39 and 29 through the sequential valve 31 in the conduit 30 to the motor 15, while the return oil is conveyed from the motor 15 via the ports 23, 38 in the main valve 20 and via the conduits 41, 60, 61, 65 to the return oil tank 35.

Figure 2:
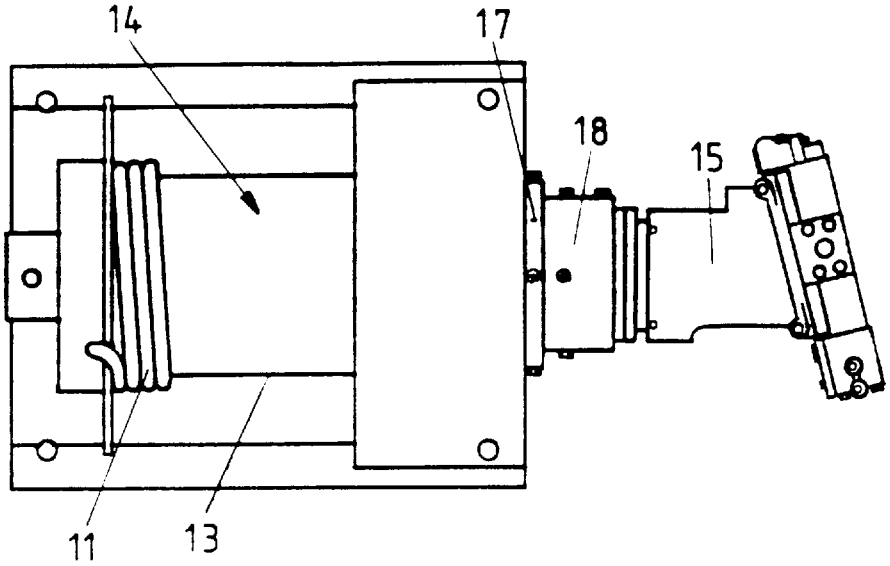
FIG. 2 shows in side view a winch for use in the hydraulic system according to FIG. 1.

In FIG. 2 there is shown a winch corresponding to the winch 14 of FIG. 1, having the drum 13 arranged on the one side of a winch housing 14*a* and the gear 17, the brake 18 and the hydraulic drive motor/pump 15 arranged on the opposite side of the winch housing 14*a*. On the drum 13 some windings of hoisting wire 11 are shown.

Figure 3:
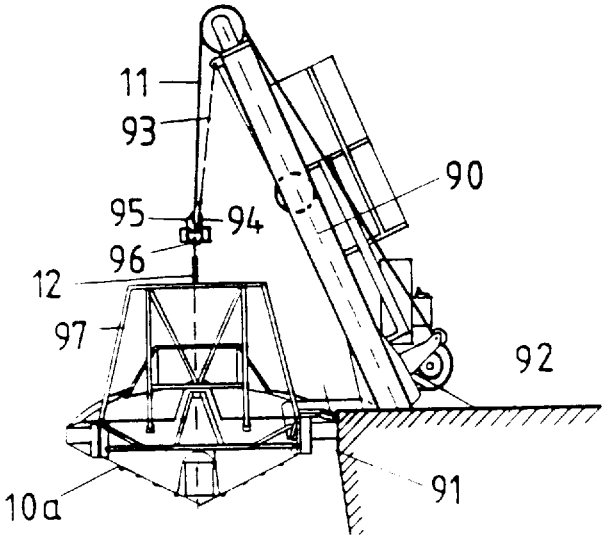
FIG. 3 illustrates a side view of a crane employing a winch and hydraulic system in accordance with the invention for quartering a boat.
Figure 4:
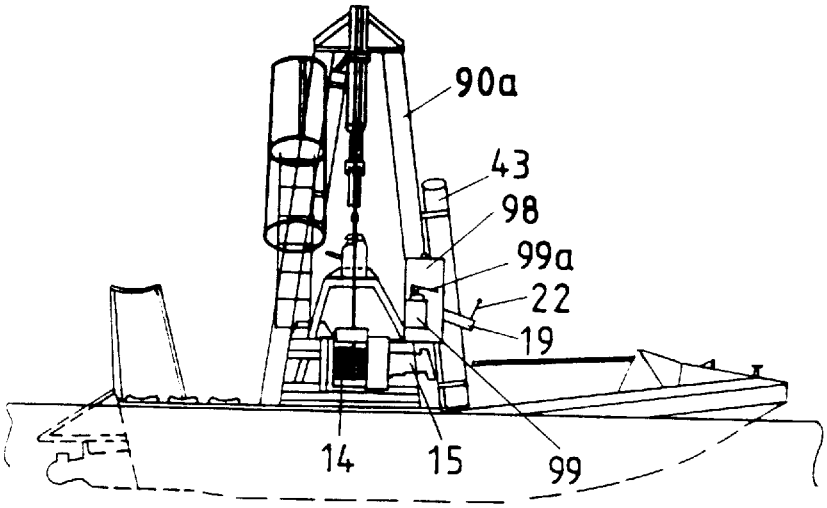
FIG. 4 illustrates a side view of the crane of FIG. 3.
Figure 5:
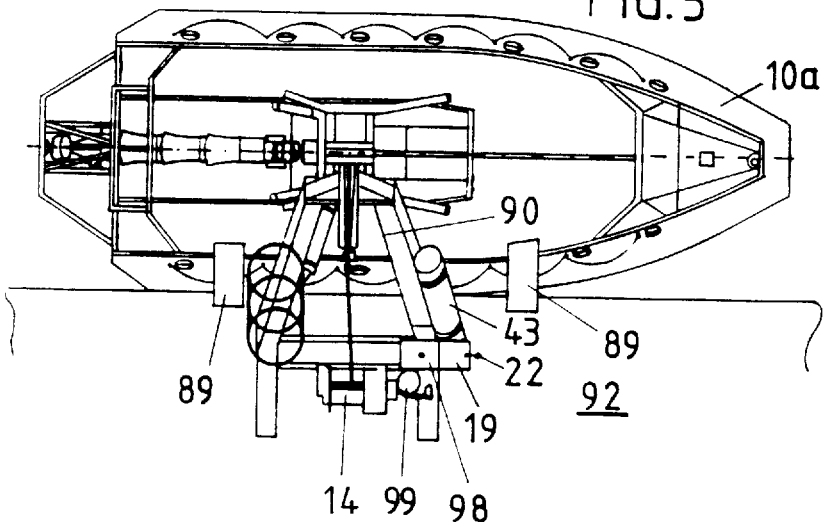
FIG. 5 illustrates a top view of the crane and boat of FIG. 3.

In FIGS. 3–5 a crane 90 is shown for the launching of a so-called "MOB-boat" (man-over-board boat) 10*a* from an inactive position just outside a deck termination 91 on a platform deck 92. The boat 10*a* is locked in place in the illustrated inactive position with a pair of readily releasable lashings 89. In addition there is employed a separate safety line 93 fastened in between the outer end of the crane 90 and the boat 10*a*, where the line 93 via a hook 94 is fastened together with a hoisting line hook 95 in a common fastening ring 96 which is hooked into a manually releasable hook holding means 12 fastened to the top of a support hoop 97 in the boat 10*a*. After releasing lashings 89 and the safety line 93 the boat 10*a* is ready for launching by actuating control valve 19 of the winch. If necessary the control valve 19 can be actuated by remote control from the boat. After the boat 14*a* is put down on the sea the boat can be set free from the hoisting wire 11 by manual release of the hook holding means 12. In instances where the boat after use is to be raised up again to the starting position on the deck 92 a separate crane (not shown further) can be employed for this.

The crane 90 carries the winch 14 at its lower end and has the accumulator 43 fastened along one side portion 90*a* of the crane. Between the accumulator 43 and the hydraulic motor/pump 15 of the winch there is illustrated the control valve 19 with associated handle 22. In addition there is shown an extra oil container 98 and a manual pump 99 with associated pump handle 99*a*. The pump 99 is coupled to the motor/pump 15 in a manner not shown further so that one can undertake manual lifting of the wire 11 with associated empty hook in an emergency where this has to be necessary.

In cases where for example several rafts are to be launched in succession from one and the same launching station, there can be employed instead of the illustrated crane 90 a davit arrangement or a crane arrangement which is specifically designed for such a purpose, so that the lifeboats can be swung with the davit arrangement or the crane arrangement from an inactive position on deck to an active launching position outside the deck. If necessary this task of swinging can also be carried out by means of the force of pressure oil which is stored in the accumulator 43 after a preceding launching operation.

We claim:

1. A hydraulic system for quartering cargo, said system comprising a winch for operation in a lifting direction and for operation in a quartering direction;

a control valve operable between a quartering position, a neutral position and a lifting position;

a hydraulic drive motor for driving said winch;

a first conduit connection connected to and between one operative side of said motor and said control valve, a first back pressure valve in said first conduit connection to prevent a flow of pressure oil from said control valve to said operative side of said motor and to allow a flow of pressure oil from said motor to said control valve;

a second conduit connection connected to and between said one operative side of said motor and said control valve;

a second back pressure valve in said second conduit connection to prevent a flow of pressure oil from said drive motor to said control valve and to allow a flow of pressure oil from said control valve to said drive motor; and an oil-gas accumulator, said drive motor being connected to said accumulator via said control valve with said control valve in said quartering position for storing pressure oil in said accumulator during operation of said winch in said quartering direction;

said hydraulic drive motor being connected to said accumulator via said control valve with said control valve in said lifting position to receive pressure oil from said accumulator during operation of said winch in said lifting direction.

2. A system as set forth in claim 1 which further comprises a quantity regulating valve in said first conduit connection between said first back pressure valve and said control valve for regulating the flow of pressure oil from said drive motor to said control valve with said control valve in said quartering position.

3. A system as set forth in claim 1 wherein said drive motor is adjustable between a first position having a maximum displacement for use in quartering and a second position having a minimum displacement for use in lifting, and which further comprises a position cylinder for adjusting said drive motor between said positions thereof, and a directional valve connected to said second conduit connection in parallel with said second back pressure valve, said directional valve being responsive to a pressure drop in said second conduit connection across said second back pressure valve to activate said position cylinder to adjust said drive motor from one of said positions thereof to the other position thereof.

4. A system as set forth in claim 1 which further comprises a third conduit connection between said control valve and said accumulator, a third back pressure valve in said third conduit connection to allow a flow of pressure oil from said control valve to said accumulator while preventing a flow of pressure oil from said accumulator to said control valve, a fourth conduit connection between said control valve and said accumulator, a shut-off valve in said fourth conduit connection and a fourth back pressure valve in said forth conduit connection to allow a flow of pressure oil from said accumulator to said control valve while preventing a flow of pressure oil from said control valve to said accumulator.

5. A system as set forth in claim 4 which further comprises a normally closed discharge valve connected to said control valve and a pilot conduit extending from said third conduit connection to said discharge valve to open said discharge valve in response to a high oil pressure in said pilot connection to deliver surplus pressure oil from said control valve to a return oil tank.

6. A system as set forth in claim 4 which further comprises a sequential valve connected to said control valve, a spring biasing said sequential valve into an open position to discharge pressure oil from said control valve into a return oil tank, a reverse acting control chamber for biasing said sequential valve into a closed position in response to the oil pressure in at least one of said first conduit connection between said drive motor and said first back pressure valve and said second conduit connection between said drive motor and said second back pressure valve.

7. A hydraulic system for quartering cargo, said system comprising a winch for operation in a lifting direction and for operation in a quartering direction;

a control valve operable between a quartering position, a neutral position and a lifting position;

a hydraulic drive motor for driving said winch;

a first conduit connection connecting one operative side of said motor to said control valve, a first back pressure valve in said first conduit connection to prevent a flow of pressure oil from said control valve to said operative side of said motor and to allow a flow of pressure oil from said motor to said control valve;

a second conduit connection connecting said one operative side of said motor to said control valve;

a second back pressure valve in said second conduit connection to prevent a flow of pressure oil from said drive motor to said control valve and to allow a flow of pressure oil from said control valve to said drive motor;

an oil-gas accumulator, said drive motor being connected to said accumulator via said control valve with said control valve in said quartering position for storing pressure oil in said accumulator during operation of said winch in said quartering direction;

said hydraulic drive motor being connected to said accumulator via said control valve with said control valve in said lifting position to receive pressure oil from said accumulator during operation of said winch in said lifting direction;

a third conduit connection between said control valve and said accumulator;

a third back pressure valve in said third conduit connection to allow a flow of pressure oil from said control valve to said accumulator while preventing a flow of pressure oil from said accumulator to said control valve;

a fourth conduit connection between said control valve and said accumulator;

a shut-off valve in said fourth conduit connection; and a fourth back pressure valve in said fourth conduit connection to allow a flow of pressure oil from said accumulator to said control valve while preventing a flow of pressure oil from said control valve to said accumulator.

8. A system as set forth in claim 7 which farther comprises a normally closed discharge valve connected to said control valve and a pilot conduit extending from said third conduit connection to said discharge valve to open said discharge valve in response to a high oil pressure in said pilot connection to deliver surplus pressure oil from said control valve to a return oil tank.

9. A system as set forth in claim 7 which further comprises a sequential valve connected to said control valve, a spring biasing said sequential valve into an open position to discharge pressure oil from said control valve into a return oil tank, a reverse acting control chamber for biasing said sequential valve into a closed position in response to the oil pressure in at least one of said first conduit connection between said drive motor and said first back pressure valve and said second conduit connection between said drive motor and said second back pressure valve.

* * * * *

UNITED STATES PATENT AND TRADEMARK OFFICE
CERTIFICATE OF CORRECTION

PATENT NO. : 5,806,838

ISSUED : September 15, 1998

INVENTOR(S) : Atle Kalve, Normann S. Jacobsen

It is certified that this error appears in the above-identified patent and that said Letters Patent is hereby corrected as shown below:

Column 1, line 5, change "continuation continuation" to -continuation-

Line 6, after "filed" insert -on November 30, 1995-

Signed and Sealed this

Fifteenth Day of December, 1998

Bruce Lehman

*Attest:*

BRUCE LEHMAN

*Attesting Officer*

*Commissioner of Patents and Trademarks*